United States Patent [19]

Petrilli

[11] Patent Number: 4,706,810

[45] Date of Patent: Nov. 17, 1987

[54] BOAT CONSOLE SYSTEM

[75] Inventor: Peter J. Petrilli, Miami, Fla.

[73] Assignee: Mako Marine, Inc., Miami, Fla.

[21] Appl. No.: 858,738

[22] Filed: May 2, 1986

[51] Int. Cl.[4] ..... B65D 1/22

[52] U.S. Cl. ..... 206/320; 296/37.12; 296/70; 114/343; 108/25

[58] Field of Search ..... 224/279, 281, 42.42, 224/42.43; 206/320; 296/37.1, 37.8, 37.12, 70, 71, 72; 108/25, 26, 26.2; 114/343, 352

[56] References Cited

U.S. PATENT DOCUMENTS

| | | | |
|---|---|---|---|
| 2,301,730 | 11/1942 | Mann | 224/281 X |
| 3,634,897 | 1/1972 | Cuccio | 114/343 |
| 3,674,170 | 7/1972 | Thorpe et al. | 114/343 X |
| 4,403,818 | 9/1983 | Kleinböhl | 296/70 X |
| 4,474,391 | 10/1984 | Matsuno | 296/70 X |
| 4,573,731 | 3/1986 | Knaack | 224/42.42 X |

*Primary Examiner*—Stephen Marcus
*Assistant Examiner*—Michael J. Shea
*Attorney, Agent, or Firm*—Willian Brinks Olds Hofer Gilson & Lione

[57] ABSTRACT

This invention provides an inexpensive and easily manufactured console system for small boats. The system permits electronic instruments to be attractively carried and displayed in the boat in such a manner that the instruments can be continuously monitored, easily operated, protected from damage from water and movement due to high seas, and conveniently removed from the console and easily and safely transported from the boat for safekeeping when the boat is left unattended. The system includes equipment carrier modules within which electronic instruments are fastened and carried and a module-receiving liner for supporting the modules and the equipment in the boat. The system is adapted so that a single releasable fastener may secure each module within the liner, permitting the modules and the equipment to be easily removved from the boat as a unit. The modules are designed so that two modules with equipment can be easily transported with one hand.

37 Claims, 4 Drawing Figures

BOAT CONSOLE SYSTEM

BACKGROUND OF THE INVENTION

The present invention relates generally to boat consoles and, more particularly, to a system providing a portable equipment carrier and console system for boats that is attractive and easily used.

Sophisticated electronic instruments and equipment are widely used in boating to enhance its safety, utility, and enjoyment. Such electronic instruments and equipment include, for example, depth finders, fish finders, and other sonar equipment, radar equipment, ship-to-shore radios, CB's, cellular telephones, televisions, and cassette tape players. Such equipment is expensive, lightweight, and easily carried and is desirable in the used equipment market.

The theft or destruction of such equipment, particularly marine equipment, is a serious problem in marinas and other boat-storage facilities. Many boats have open cabins and cabins closable only by curtains and do not provide security against the entry of a thief. Consequently, the portable and expensive electronic equipment is easily stolen. As a result, many boat owners want to remove the equipment from the boat during periods when the boat is unattended. Many types of equipment are also used off the boat, and boat owners frequently desire to remove the equipment from the boat for this reason as well.

Many boats are equipped with a console which provides convenient access at a single location to the controls and indicators needed to operate a boat and its accessories. Such consoles generally include shelves and compartments for receiving the electronic instruments and subsidiary equipment that the boat owner may use. Electronic instruments must be firmly fastened to the boat to protect them against damage from movements caused by the unpredictable, sometimes sudden movement of the boat in the water. Removal of electronic instruments and equipment when the boat is to be left unattended and return of the equipment to the boat when it is to be used requires unfastening and fastening the equipment to the boat and electrically disconnecting and connecting it to the boat's electrical system. In addition, most boat owners have several expensive electronic instruments installed in their boats. This removal of such equipment to protect it from theft is a time-consuming and inconvenient procedure, particularly where the equipment is built in to the boat to enhance the appearance of the boat's interior, and the inconvenience discourages such removal, which frequently must occur on an almost daily basis. Furthermore, carrying several instruments of disparate size and shape increases the risk of damage by dropping an instrument in transport.

SUMMARY OF THE INVENTION

This invention provides a portable equipment carrier system for boats that is convenient to use and permits an attractive display of the instrument panels and controls, and easy access to the instrument controls and electrical connections. The system includes at least one equipment carrier module for receiving and supporting equipment to be used on the boat, and means for releasably fastening the equipment carrier modules to said boat so the module and its supported equipment can be securely mounted in the boat and conveniently removed from the boat as a unit.

In its preferred embodiment, the system includes a module-receiving member or liner within and forming a portion of the boat console, and having one or more module-receiving compartments to receive and support one or more equipment carrier modules. The equipment is secured within the module; and the module itself is designed to be easily secured in and removed from module-receiving member or liner without removing the equipment from the module. The module-receiving compartment of the liner and the module are so shaped that the module is restrained from movement in all but one direction when the module is inserted in the liner. An easy-to-operate, single, fastener means permits the modules and equipment to be secured against movement in any direction and to be quickly fastened within or removed from the console.

In the system of the invention, the modules comprise substantially rigid, relatively lightweight containers which are adapted to receive one or more instruments or units of equipment so that the equipment can be firmly secured against movement within the modules. The modules have a generally tray-like configuration with an open front and open back, permitting easy access to instrument panels, controls, and electrical connections. The module-receiving member or liner and the modules include cooperating fastener means, such as latch means, to releasably secure the modules within the liner. The latch means are easily operated, and the module can be easily disconnected and removed from the liner whenever desired. The system also includes means for permitting rapid electrical connection and disconnection of the equipment within the module, further enhancing the ease of its use.

The modules are preferably designed so that two modules can be comfortably carried with one hand to permit equipment to be easily and safely carried to and from the boat.

The preferred embodiment provides one or more plexiglass windows carried by the liner which are movable between an open position to provide access to the equipment within the console and a closed position to protect the equipment from water or the like while permitting instrument displays to be viewed and monitored.

Thus, with the present invention, electronic instruments and other equipment can be easily and conveniently removed from a boat by its owner to prevent theft and can be easily reinstalled within a boat console in such a manner that the instruments are protected from damage due to waves and boat movement, are easily used, and are attractively presented in a boat console.

Further advantages and specific details of the invention will become apparent hereinafter in connection with the detailed description of a presently preferred embodiment thereof.

DETAILED DESCRIPTION OF THE PREFERRED EMBODIMENT

Figure 1:
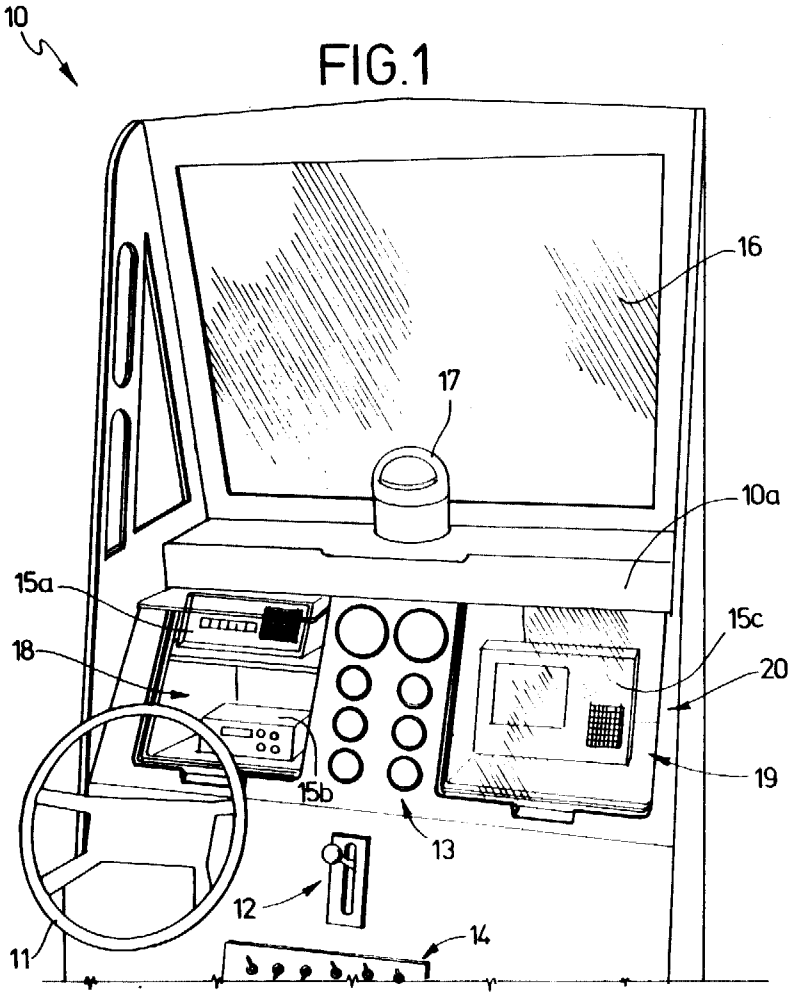
FIG. 1 illustrates a portion of a boat console incorporating a portable equipment carrier system according to a preferred embodiment of the invention.

FIG. 1 illustrates a portion of a console of an open fishing boat incorporating a portable equipment carrier system of this invention. The console is generally designated by reference numeral 10 and comprises a cabinet which contains and provides convenient access at a single location to the various controls and indicators needed to operate a boat and its accessories. Console 10 includes a steering wheel 11, a throttle 12, various dials and other indicators 13 for the propulsion system, a number of control switches 14, a windshield 16, and a built-in compass 17 and may include other features and accessories well known to those skilled in the art.

As indicated above, electronic instruments and other subsidiary equipment are often used on a boat. Such equipment may include communication equipment, such as radios or CB's; depth finders, fish finders, and other sonar systems; radar receivers; and apparatus for entertainment purposes, such as televisions and cassette tape players.

Because of the high incidence of theft and vandalism at boat marinas and storage facilities, and because some of the equipment may be used both on and off a boat, it is advantageous for boat owners to remove such equipment from the boat during periods when the boat is unattended and to return the equipment to the boat when it is needed. Such a practice has been time consuming and inconvenient because of the of the difficulty of unfastening the equipment which must be mechanically secured to the boat to prevent it from being damaged by the frequent, sometimes severe movement of the boat. The pieces of equipment which are desirably removed from the boat are frequently of irregular and disparate shapes increasing the risk of damage by dropping during transport to and from the boat.

Much of the inconvenience associated with the frequent removal and transport of electronic instruments and other subsidiary equipment to and from a boat is alleviated by the portable equipment carrier system of this invention. Console 10 includes two compartments for receiving and supporting electronic instruments and equipment schematically illustrated at 15*a*, 15*b*, and 15*c*. The system, which is generally designated by reference numeral 20, includes one or more equipment carrier modules within which the equipment is secured and which can be easily fastened in and removed from the boat console as a unit to permit the equipment to be easily transported to and from the boat whenever desired.

Figure 2:
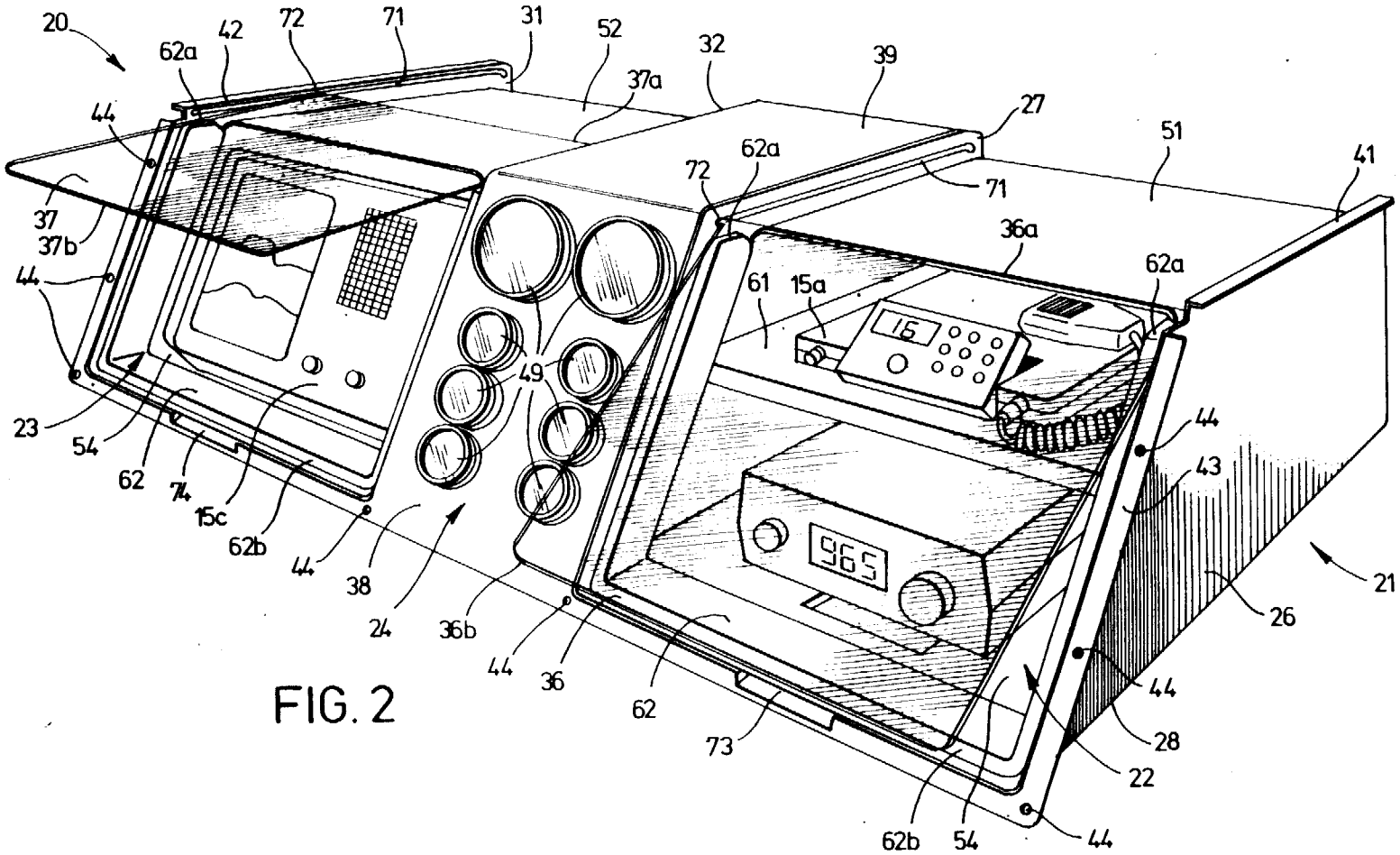
FIG. 2 illustrates the module-receiving member of the equipment carrier system of FIG. 1 supporting two equipment carrier modules.
Figure 3:
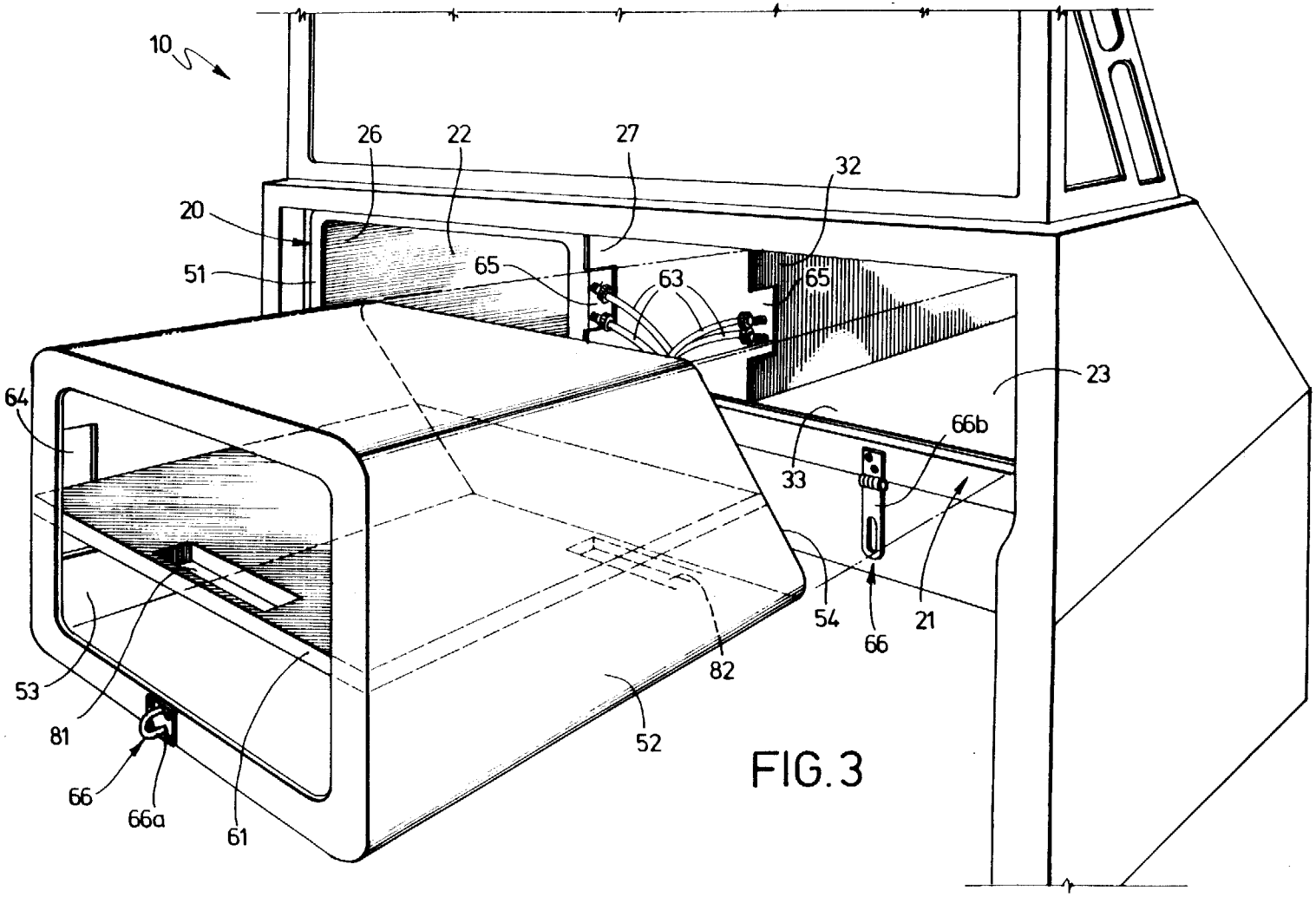
FIG. 3 illustrates a rear view of the console of FIG. 1 with the equipment carrier system in partially disassembled form to illustrate some of its detail.

Portable equipment carrier system 20 is illustrated in greater detail in FIGS. 2 and 3 and comprises means to house the modules, a module-receiving member or liner 21, which is adapted to be incorporated into and to form the upper portion of console 10. Liner 21 includes first and second module-receiving portions 22 and 23 and a central gauge panel portion 24. First module-receiving portion 22 is defined between a pair of outer and inner sidewalls 26 and 27; second module-receiving portion 23 is defined between a pair of outer and inner sidewalls 31 and 32; and gauge panel portion 24 is between the inner sidewalls 27 and 32. First and second module-receiving portions 22 and 23 include supportive bottoms and are open at their front, back, and top sides, although, as will be described hereinafter, the front of each module-receiving portion is adapted to be covered by a movable door or window 36 and 37, respectively, to provide access to the equipment stored within the console. Gauge panel portion 24 also has an open back side and is preferably open at its bottom.

Liner 21 is of one-piece construction and preferably comprises a relatively rigid, vacuum-formed plastic such as ABS plastic. Liner 21 is designed to be inserted or otherwise incorporated into the upper portion of console 10 and includes a pair of upper side flanges 41 and 42 adapted to be fastened to upper edges of the sidewall panels of console 10, and a front flange 43 positioned to abut against and be fastened to the front wall of the console. The liner is secured within the console by screws (not shown) extending through aligned holes 44 in the front flange and in the console. An appropriate top console panel 10*a* (FIG. 1) can be mounted in place over the liner 21 to provide a shelf on top of the console 10.

Module-receiving portions 22 and 23 of liner 21 are sized to receive and support a pair of equipment carrier modules 51 and 52, respectively, as shown in FIGS. 2 and 3. As shown in FIG. 3, the modules are of generally rectangular cross section and are open at their back ends 53 to permit electronic instruments and other equipment to be inserted into and secured within the modules, and at their front ends 54 (FIG. 2) to provide access to the instruments within the module. The modules are configured to fit within the liner 21, and the front ends 54 thereof are angled in a manner similar to that of the liner 21. The modules are formed of a sturdy, relatively lightweight material, and a preferred material is white, vacuum-formed, ABS plastic.

Modules 51 and 52 comprise portable substantially rigid bodies for receiving and supporting various electronic instruments and other equipment schematically illustrated by reference numerals 15*a*, 15*b*, and 15*c*. Depending on the size of the equipment to be retained within the modules, one or both of the modules 51 and 52 can include a centrally positioned shelf 61. The equipment is rigidly fastened to and housed within the modules to prevent its movement within the modules while the boat is in operation and the modules are being transported to and from the boat. The manner of fastening the equipment to the modules will vary depending on the nature and configuration of the equipment. Typically, the equipment is secured within the modules by bolts, screws, or other appropriate means so that the equipment will be prevented from moving within the modules at all times.

Modules 51 and 52, with the equipment 15*a*, 15*b*, and 15*c* fastened therein, are adapted to be inserted into and removed from module-receiving portions 22 and 23 of liner 21 through the open back end of the liner 21 with the liner mounted within the console 10 as shown in FIG. 3. When the modules are inserted through the back open end of liner 21, they are pushed forwardly into module-receiving portions 22 and 23 until they are stopped by the inwardly projecting portion 62 formed by the forward end of the liner 21 within module-receiving portions 22 and 23 (FIG. 2). Because the projecting portion 62 is inclined rearwardly and generally parallel to the front face of the liner, projecting portion 62 not only limits the forward movement of the modules within the liner but also holds the modules against the liner bottom when fastened in place and secures the modules against up and down movement.

After the modules are positioned within liner 21, the modules are fastened within the liner by fastener means 66. Fastener means 66 comprise easy-to-operate releasable fasteners which can be operated quickly to lock the modules in position within the liner. In the illustrated embodiment, fastener means 66 comprise latches having cooperating portions 66*a* and 66*b* mounted on the modules and liner, respectively, and which can be engaged to lock the modules in the liner and separated to release the modules. The fastening means 66 are preferably provided at the rear of the modules 51 and 52 and liner 21 but are located to prevent the rearward movement of the modules and to hold them against projecting portion 62 so that the modules are also secured against horizontal and vertical movement.

After the modules are positioned within liner 21, the electronic equipment carried by the modules can be connected to electronic harnesses 63 and wiring which is within the console and which can extend upwardly through the open bottom of the central gauge panel portion 24 of the liner. Each module includes an opening 64 in a sidewall positioned to be aligned with an opening 65 in the inner sidewalls 27 and 32 of the liner 21 when the modules are positioned in the liner. The wiring to interconnect the electronic equipment, if necessary, and to provide power from the electrical system of the boat can be extended through the aligned openings 64 and 65 or through the open backs of the modules.

After the modules are positioned and secured within the liner and electrical connection of the equipment is completed, a hinged back panel or the like can be closed over the back face of the console, as known by those skilled in the art, to enclose the modules. The modules and the instruments carried therein are thus securely fastened within the console to effectively protect the instruments during use of the boat.

As shown in FIG. 2., access to the instruments in the console is provided through the front open end of module-receiving portions 22 and 23 of liner 21. More particularly, the liner 21 includes preferably a pair of windows 36 and 37 of plexiglass or the like which are pivotally movable between a first down position to close the front ends of the module-receiving portions, and a second, raised position to provide access to the instruments in the modules. Preferably, the liner 21 is formed with grooves 71 in the sidewalls 26, 27 and 31, 32 of its module-receiving portions 22 and 23; and each of the windows 36 and 37 includes a pair of pins 72 in their sides at their respective tops 36*a* and 37*a*. The pins 72 are positioned to ride in grooves 71 formed in the liner as illustrated in FIG. 2 so that the windows can be pivoted upward and then slid backwardly in the grooves to retain the windows in an open, out-of-the-way position. In the open position, the bottom portions 36*b* and 37*b* of the windows 36 and 37 rest on the tops 62*a* of projecting portions 62. Projecting portion 62 also forms ledges 62*b* on which the windows 36 and 37 rest when they are closed.

The liner 21 is preferably formed with a pair of indentations 73 and 74 to permit the operator to reach under the windows and pivot them upwardly. The windows are easily raised to provide convenient access to the instruments in the console. When closed, the windows protect the electronic instruments from water or the like while permitting the displays on the instruments to be monitored.

A important feature of the portable equipment carrier system of the present invention is that the modular construction enables instruments and other equipment to be easily removed from the boat and transported to a secure location when the boat is left unattended. With the system of the present invention, it is only necessary to release the back panel of the console, disconnect the wiring, and release latches 66 to remove instruments 15*a*, 15*b*, and 15*c* from the boat. The modules 51 and 52 can then be removed from liner 21 through its open back and carried away from the boat. A slot 81 can be provided at the back of the modules, as, for example, in the shelf 61, to assist in removal of those modules.

Figure 4:
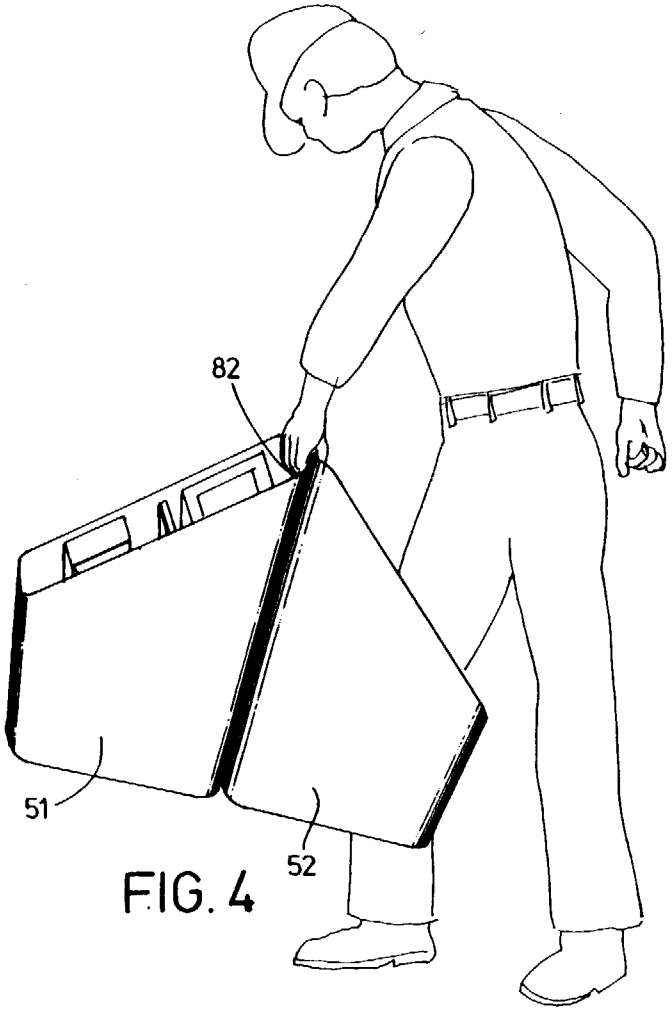
FIG. 4 illustrates a person carrying two equipment carrier modules of the portable equipment carrier system of FIG. 1.

The modules 51 and 52 include slots 82 in their base adjacent their front ends. Slot 82 is positioned to permit the modules and equipment fastened therein to be easily carried to and from the boat. As shown in FIG. 4, the modules are configured so that two modules can be positioned in base-to-base relationship with slots 82 aligned with one another, permitting both modules to be easily carried with one hand. The risk of dropping or otherwise damaging the equipment during transport to and from the boat is thus greatly reduced.

The invention thus provides a console system which permits electronic instruments to be attractively carried and displayed in the boat in such a manner that the instruments can be continuously monitored, easily operated, protected from damage from water and movement due to high seas, and to be conveniently removed from the console and easily and safely transported from the boat for safekeeping when the boat is left unattended. The console system is particularly well adapted to use on smaller open-cabin sport boats, such as central console fishing boats. The system is inexpensively manufactured but exceptionally attractive.

As apparent from FIG. 2, the console liner 21 is, in one preferable configuration, vacuum formed to provide two open-front, open-back, open-top portions, each defined by a bottom and a pair of sidewalls. Such a vacuum-formed configuration is easily manufactured in a single piece from a single piece of attractive, thermoplastic material such as white ABS plastic. The open-front, open-back, open-top portions of the liner 21 permit tray-like modular equipment carriers to be easily inserted into and removed from the liner. The tray-like modules or carrier can also be easily and inexpensively manufactured from thermoplastic material by thermoforming or molding. The modules or carriers are preferably of such a size and shape that they fit closely within the sidewalls, and their forward faces are preferably sloped to match a portion at the front of the liner that is formed to project into the module-receiving portion and to incline rearwardly so that when the modules are held against this liner portion by fastening means, they can be secured against both horizontal and vertical movement. Thus, in the preferred embodiment of the drawing, the liner 21 provides means to restrain the modules against movement in all but one direction and permits the modules to be secured against any movement by a single, easily operated fastening means conveniently located at the open rear end of the liner. The projecting portion 62, in addition, forms an inclined ledge to support the windows of the system, when closed, in an attractive and convenient inclined position.

While I have described a presently preferred embodiment of the invention, it should be understood that the invention could take various other forms. For example, although a system having two modules is described, the liner 21 can be designed for supporting one or more modules. In addition, the configuration of the liner and the modules can be varied for use with consoles of different configuration. Because the invention can take many forms, it should be understood that the invention is to be limited only insofar as is required by the scope of the following claims.

I claim:

1. A portable equipment carrier system for boats and the like, comprising:

a receiving part adapted to receive one or more equipment carrier modules, said receiving part having means formed at one end thereof for engaging one or more equipment carrier modules and for preventing movement of the one or more equipment carrier modules within the receiving part in all but one direction;

one or more equipment carrier modules for receiving and supporting equipment to be used on a boat; and fastener means adjacent the opposite end of said receiving part for releasably fastening said one or more equipment carrier modules in said receiving part whereby each of said one or more equipment carrier modules and equipment supported therein can be readily mounted in and removed from said receiving part as a unit.

2. The system of claim 1 wherein said receiving part is positioned within a boat console and includes a plurality of module-receiving portions for receiving and supporting said one or more equipment carrier modules within said receiving part.

3. The system of claim 2 wherein said receiving part includes transparent window means movable between a first closed position closing and one or more module-receiving portions and a second open position providing access to equipment in said one or more equipment carrier modules when said one or more equipment carrier modules are positioned within said receiving part.

4. The system of claim 3 wherein said receiving part includes means at said one end thereof for pivotally mounting said transparent window means between said first closed position and said second open position.

5. The system of claim 2 wherein said receiving part further includes a gauge panel portion for supporting gauges and other indicators within said boat console.

6. The system of claim 1 wherein said receiving part comprises a one-piece, molded, plastic insert.

7. The system of claim 1 wherein said one or more equipment carrier modules each comprises a one-piece, molded, plastic module.

8. The system of claim 7 wherein said one or more one-piece, molded, plastic modules each comprise a vacuum-formed ABS plastic module.

9. The system of claim 2 wherein each of said one or more equipment carrier modules includes aperture means formed in a wall thereof to permit wiring to extend from equipment retained therein into said boat console.

10. The system of claim 1 wherein each of said one or more equipment carrier modules includes handle means for permitting each of said one or more equipment carrier modules and equipment secured therein to be carried to and from said boats and the like.

11. A portable equipment carrier system for boat consoles and the like, comprising:

one or more equipment carrier modules for receiving and supporting equipment to be secured therein;

housing means having one or more module-receiving compartments for receiving and supporting said one or more modules, said housing means being adapted to be incorporated within a boat console and including means formed at one end thereof for engaging said one or more modules and for preventing their movement in all but one direction; and releasable fastener means at the end of said housing means opposite said one end for releasably fastening said one or more modules and equipment secured therein in said one or more module-receiving carpartments, respectively, of said housing means.

12. The system of claim 11 wherein said releasable fastener means comprises a single locking means for said one or more modules, said single locking means having portions on said housing means and on said one or more modules for releasably fastening said one or more modules within said one or more module-receiving compartments.

13. The system of claim 11 wherein said housing means further includes a gauge panel portion for supporting a plurality of gauges or other indicators thereon.

14. The system of claim 12 wherein said housing means comprises a one-piece, molded, plastic liner inserted within said console.

15. The system of claim 14 wherein said one or more modules comprise two modules and wherein said one or more module-receiving compartments comprise two module-receiving compartments in said liner.

16. The system of claim 15 wherein each of said modules includes handle means for carrying said modules and equipment secured therein.

17. The system of claim 12 wherein each of said one or more modules comprises a molded plastic module.

18. The system of claim 15 wherein said liner includes two transparent windows mounted to a front wall thereof for providing access to equipment in said two modules, said windows being movable between an open position providing access to equipment in said modules and a closed position preventing access to equipment in said modules.

19. A portable equipment module for boat consoles and the like, comprising:

a substantially rigid body configured to have a tapered portion and to receive equipment to be secured therein;

fastener means for releasably fastening said rigid body in a boat console and the like; and handle means for carrying said rigid body and equipment secured therein whereby said module and equipment secured therein can be inserted into or removed from said console and the like and transported to and from said console and the like as a unit, said handle means comprising a slot extending through a wall of said tapered portion whereby two modules positioned in side-to-side relationship can be carried with one hand.

20. The module of claim 19 including an aperture in a wall of said rigid body to permit connection of equipment therein to said boat console and the like.

21. The module of claim 19 wherein said fastener means comprises a latch member on said body adapted to receive a latch for fastening said body within said console and the like.

22. The module of claim 19 wherein said body comprises a molded plastic member.

23. The module of claim 22 wherein said molded plastic member comprises an ABS plastic member.

24. A console system for an open-cabin boat, comprising:

a vacuum-formed console liner, said vacuum formed console liner providing an open front and back formed by a pair of sides and a bottom said open front being defined by a vacuum-formed portion projecting inwardly from the pair of sides and bottom to define a stop;

an electronic component carrier, said carrier being adapted to be insertable into the open back of said console liner and including a forward face adapted to engage said stop, said vacuum-formed inwardly projecting stop and said forward face of said carrier being adapted to prevent forward and vertical movement of said carrier of said carrier can be secured in said liner by a single fastening means permitting electronic components in said carrier to be easily removed from and replaced on a boat.

25. The console system of claim 24 wherein said vacuum-formed, projecting portion defining the front of the vacuum-formed console liner also defines at its front a ledge and includes along the upper edges of each of the pair of sides, a portion defining a pair of tracks, and wherein said system includes a window having at its upper portion means adapted to slide along the pair of tracks, said window having a size to close the open front of the console liner by resting on said ledge when in a down position and to rest on the upper edges of the inwardly projecting portion of the console liner when slid backwardly along the pair of tracks to open the console for access to electronic components carried by said component carrier.

26. The console system of claim 24 wherein the electronic component carrier includes a slot defining a handhold adjacent its front end and the fastening means is located at its rear end.

27. A portable equipment carrier system for boats and the like, comprising:

a one-piece, molded, plastic insert adapted to receive one or more equipment carrier modules, said insert having means formed in its forward end to engage the one or more equipment carrier modules to prevent their forward and vertical motion within said insert, and to permit each of said one or more equipment carrier modules to be secured against movement within said insert by a single fastening means;

one or more equipment carrier modules for receiving and supporting equipment to be used on a boat; and fastening means for releasably fastening said one or more equipment carrier modules in said insert, said fastening means being positioned at the rear end of each of said one or more equipment carrier modules whereby each of said one or more equipment carrier modules and equipment supported therein can be readily mounted in and removed from said insert as a unit.

28. The system of claim 27 wherein said means formed in the forward end of said insert forms a ledge, and said insert carries a pair of doors that rest on said ledge when said pair of doors is in a closed position.

29. A portable equipment carrier system for boats and the like, comprising:

one or more equipment carrier modules for receiving and supporting equipment to be used on a boat, each of said one or more modules including handle means comprising a slot formed within a wall thereof for permitting said one or more modules and equipment secured therein to be carried to and from said boat; and means for releasably mounting said one or more equipment carrier modules in said boat whereby each of said one or more modules and equipment supported therein can be readily mounted in and removed from a boat as a unit.

30. A portable equipment carrier system for boat consoles and the like, comprising:

one or more equipment carrier modules for receiving and supporting equipment to be secured therein, each of said one or more modules having an aperture therein;

housing means having one or more module-receiving compartments for receiving and supporting said one or more modules, said housing means being adapted to be incorporated within a boat console and including one or more apertures aligned with said apertures in said one or more modules when said modules are received and supported in said one or more module-receiving compartments where by wiring is adapted to be extended through said aligned apertures in said modules and said housing means to electrically connect equipment in said modules to wiring in said console; and releasable fastener means for releasably fastening said one or more modules and equipment secured therein in said one or more module-receiving compartments, respectively of said housing means.

31. The system of claim 30 wherein said housing means comprises a one-piece, molded, plastic liner inserted within said console.

32. The system of claim 31 wherein each of said one or more modules comprises a molded plastic module.

33. In a boat console system for receiving instruments or equipment, the improvement comprising a one-piece liner vacuum-formed to provide a plurality of equipment carrier portions, each equipment carrier portion being defined by a pair of sidewalls and a bottom wall and providing a substantially open front, open back and open top, said open front and open back permitting easy insertion of and access to equipment carried within the portion.

34. In the system of claim 33, the improvement wherein the sidewalls of each equipment carrier portion are formed with a part projecting inwardly into the equipment carrier portion.

35. In the system of claim 34, the improvement wherein the part projecting inwardly into the equipment carrier portion is located at the open front of each equipment carrier portion in both sidewalls and the bottom and forms a rearwardly inclined stop and rearwardly inclined ledge.

36. In the system of claim 33, the improvement wherein the liner is vacuum-formed to provide an enclosure between the equipment carrier portions adapted to provide an instrument panel.

37. In the system of claim 33, the improvement wherein one or more tray-like modular equipment carriers slidably engage the sidewalls and bottom of the equipment carrier portions of the liner.

* * * * *

UNITED STATES PATENT AND TRADEMARK OFFICE

CERTIFICATE OF CORRECTION

PATENT NO. : 4,706,810

DATED : NOVEMBER 17, 1987

INVENTOR(S) : PETER J. PETRILLI

It is certified that error appears in the above-identified patent and that said Letters Patent is hereby corrected as shown below:

In the ABSTRACT, line 16, delete "removved" and insert -- removed -- therefor.

In col. 7, line 34 (claim 3, line 3), delete "and" and insert -- said -- therefor; line 49 (claim 7, line 2), delete "comprises" and insert -- comprise -- therefor.

In col. 8, line 13 (claim 11, line 17), delete, "carpartments" and insert -- compartments -- therefor.

In col. 9, line 7 (claim 24, line 5), after "bottom", insert -- , -- (comma); line 17 (claim 24, line 15, delete "of" (second occurrence), and insert -- so -- therefor.

Signed and Sealed this

Fourteenth Day of June, 1988

*Attest:*

*Attesting Officer*

DONALD J. QUIGG

*Commissioner of Patents and Trademarks*